United States Patent [19]

Pan et al.

[11] 4,202,744

[45] May 13, 1980

[54] PRODUCTION OF HYDROGEN

[75] Inventors: Yen-Chi Pan, Westfield; John S. Batzold, Union, both of N.J.

[73] Assignee: Exxon Research & Engineering Co., Florham Park, N.J.

[21] Appl. No.: 38,925

[22] Filed: May 14, 1979

[51] Int. Cl.[2] ..... C25B 1/02

[52] U.S. Cl. ..... 204/129; 423/644; 423/648 R; 423/657; 423/658

[58] Field of Search ..... 423/644, 648 R, 657, 423/658; 204/129

[56] References Cited

U.S. PATENT DOCUMENTS

| | | | |
|---|---|---|---|
| 3,615,298 | 10/1971 | Benson | 423/658 |
| 3,619,142 | 11/1971 | Johnson et al. | 423/658 |
| 3,880,987 | 4/1975 | Nahas | 423/648 R |

*Primary Examiner*—R. L. Andrews
*Attorney, Agent, or Firm*—Jerome E. Luecke

[57] ABSTRACT

Hydrogen is produced in a cyclic metals oxidation/carbon reduction process. In particular, elemental iron or cobalt is oxidized in an aqueous solution of an alkali metal hydroxide with the simultaneous generation of hydrogen. The iron or cobalt oxidation products of the reaction are thereafter reduced to elemental iron or cobalt by contact with a carbonaceous reducing agent at elevated temperatures and the reduced material recycled for reoxidation. In an alternate operation, hydrogen is produced in a cyclic electrolytic/carbon reduction process wherein elemental iron or cobalt is electrolytically converted to corresponding oxidation products with the simultaneous generation of hydrogen. The electrolytic cell used in this process comprises a cathode, a magnetic anode that is adapted to attract and retain iron and/or cobalt particles and an aqueous electrolyte. In the electrolytic cell, hydrogen is produced at the cathode and metal particles contained on the magnetic electrode are oxidized to a non-ferromagnetic specie, such as ferrous hydroxide. The non-ferromagnetic species are recovered from the electrolytic cell and thereafter reconverted to particulate elemental iron and/or cobalt by treating the material with a carbonaceous reductant at an elevated temperature.

10 Claims, 4 Drawing Figures

PRODUCTION OF HYDROGEN

BACKGROUND OF THE INVENTION

A. Field of the Invention

This invention relates to a process for the manufacture of hydrogen. More particularly, the invention is concerned with a cyclic technique wherein (i) elemental iron or cobalt is oxidized in an aqueous media with the corresponding production of hydrogen and (ii) the reduction of the iron or cobalt oxidation products with a carbonaceous reductant for subsequent reuse in the process.

B. Description of the Prior Art

Electrolytic cells having magnetic electrodes and/or means for supplying consumable metallic material to the electrode have been described in U.S. Pat. No. 38,811,952 and in U.S. Pat. No. 4,095,015. Further, the reduction of iron ore or other oxygenated iron species with carbonaceous reducing agents is well-known. For example, iron ore granules have been contacted in a fluidized bed regime with reducing agents derived from petroleum oils. Examples of such operations are disclosed in U.S. Pat. Nos. 3,551,215 and 3,615,352. A moving bed scheme for the reduction of iron ore with coal is described in Japanese Kokai No. 47-31805. Finally, U.S. Pat. No. 4,081,337 describes an electrolytic method for the production of hydrogen. In this patent, the inventor advocates a process for oxidizing an alkali sulfide in an electric cell to the corresponding alkali sulfate with the concurrent generation of hydrogen at the cathode. The alkali sulfate material is subsequently reduced to alkali sulfide by reaction of the sulfate with a carbonaceous material at elevated temperatures.

SUMMARY OF THE INVENTION

In accordance with the present invention, hydrogen is produced by (1) passing an aqueous alkali metal hydroxide solution and elemental iron or cobalt particles to a reaction zone; (2) oxidizing a portion of the iron or cobalt particles to iron or cobalt oxidation products, in particular to iron and cobalt hydroxides, with the simultaneous generation of hydrogen; (3) passing the hydrogen and the iron or cobalt oxidation products from the reaction zone; (4) reducing at least a portion of the iron or cobalt oxidation products to elemental iron or cobalt by contacting the same or with a carbonaceous reduction agent, preferably carbon monoxide; and (5) recycling at least a portion of the elemental iron or cobalt derived from the reduction step to the reaction zone for subsequent reuse.

In another embodiment of the invention, hydrogen is produced by (1) passing an aqueous electrolyte and elemental iron or cobalt particles to an electrolytic cell comprising a cathode and a magnetic anode that is adapted to attract and retain iron or cobalt particles; (2) anodically oxidizing the iron or cobalt particles to non-ferromagnetic iron or cobalt containing species with the generation of hydrogen at the cathode; (3) passing the generated hydrogen and the oxidized, non-ferromagnetic iron or colbalt containing species from the cell; (4) reducing at least a portion of the oxidized, non-ferromagnetic iron or cobalt containing species to elemental iron or cobalt by contacting the same with a carbonaceous reducing agent at elevated temperatures; and (5) recycling at least a portion of the elemental iron or cobalt derived from the reduction step to the electrolytic cell. In the chemical oxidation of elemental iron or cobalt in an aqueous alkali metal hydroxide solution, the production of hydrogen proceeds spontaneously at relatively low temperatures. Accordingly, in an electrochemical operation, hydrogen may be generated, depending upon process temperature and caustic concentration, by the chemical oxidation of the metals through contact with an aqueous alkali electrolyte and via the anodic oxidation of the metal.

BRIEF DESCRIPTION OF THE DRAWINGS

The invention will be better understood by reference to the appended drawings in which.

Figure 1:
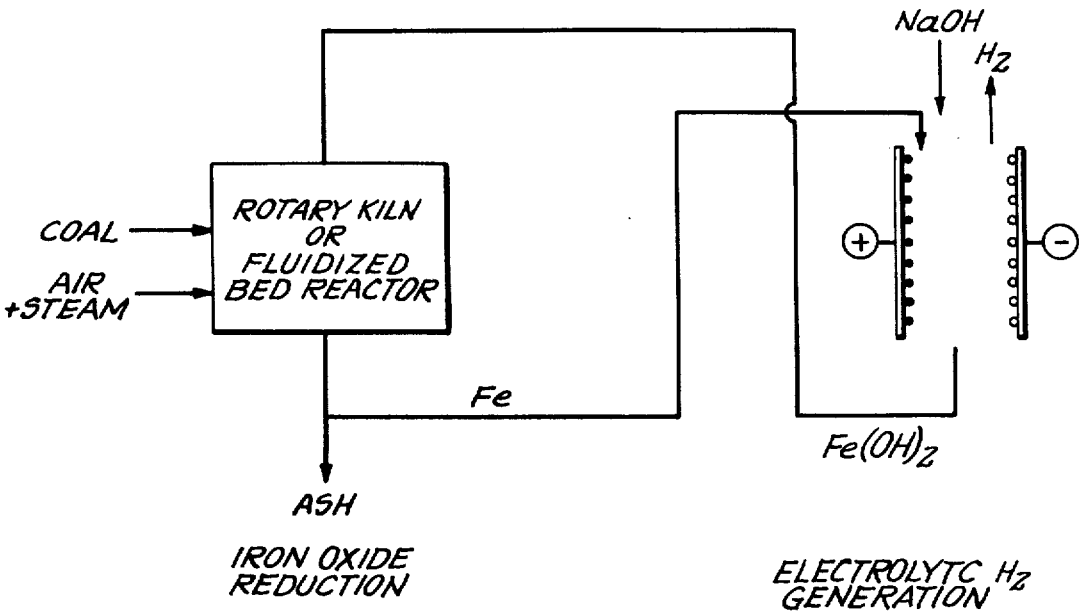
FIG. 1 is a schematic representation of one process embodiment of the present invention.

Exemplary reactions contemplated in an electrochemical system are shown below using the assumption that the iron or cobalt particles at the anode are converted first to $Co(OH)_2$ or $Fe(OH)_2$. In the electrochemical operation the iron materials can be converted to various other oxidized species such as $Fe_2O_3$ or FeO.

Cathode Reaction $$2H_2O + 2e \rightarrow 2OH^- + H_2 \uparrow \quad 0.00\ V/RHE \text{ at } 25^\circ C.$$

Anode Reactions $$Fe + 2OH^- \rightarrow Fe(OH)_2 + 2e - 0.049\ V/RHE \text{ at } 25^\circ C.$$

$$Co + 2OH^- \rightarrow Co(OH)_2 + 2e + 0.090\ V/RHE \text{ at } 25^\circ C.$$

Reduction Reactions $$\begin{cases} Co(OH)_2 \rightarrow CoO + H_2O \\ 2CoO + C \rightarrow 2Co + CO_2 \end{cases}$$

$$\begin{cases} Fe(OH)_2 \rightarrow FeO + H_2O \\ 2FeO + C \rightarrow 2Fe + CO_2 \end{cases}$$

Total Reaction $$C + 2H_2O \rightarrow CO_2 + 2H_2$$

As noted in the above equation, the electrolytic cell anode reaction consists of oxidizing elemental iron or cobalt to an oxidized species, preferably to a non-ferromagnetic oxidized species such as $Co(OH)_2$, $Fe(OH)_2$, FeO, $Fe(OH)_3$ or $Fe_2O_3$. $Fe_3O_4$ is undesirable as it is ferromagnetic.

Admixtures of elemental iron with iron sulfide are particularly effective anode materials, even though iron sulfide is not ferromagnetic since the presence of sulfur appears to promote the rate of oxidation of the iron at the anode. The elemental iron or cobalt reagent is desirably introduced into the electrolytic cell or in the reaction zone in the form of particles having an average particle size diameter of about 1 to 800 microns, preferably 10 to 100 microns.

The cell electrolyte is an aqueous electrolyte system, preferably an aqueous alkali metal hydroxide solution. Spontaneous, non-electrolytic oxidation of the iron or cobalt reagents are also conducted in an aqueous alkali hydroxide solution. Aqueous solutions of sodium hydroxide or potassium hydroxide are the preferred electrolyte systems or reaction media. Aqueous NaOH is the most preferred material. When alkali metal hydroxides are employed, they are typically present in the electrolyte solution or reaction media in amounts ranging from about 10 to 70, preferably 30 to 50 weight percent based on total solution. The precise concentration of alkali metal hydroxide employed is dependent, in part, upon the temperature employed in the electrolytic or spontaneous reaction.

Electrolytic cell reactions involving either iron or cobalt are typically conducted at temperatures ranging from about 80° C. to temperatures in excess of 300° C. Typically, the electrolytic cell operation will be conducted at temperatures varying from 80° to 400° C., preferably 120° to 180° C. Spontaneous non-electrolytic reactions may be conducted at temperatures ranging from about 80° to 400° C. when iron is the process feedstock and at temperatures ranging from about 110° to 400° C. when the cobalt is the process feedstock. The reaction zone or electrolytic cell is pressurized if the process is conducted at temperatures greater than about 140° C., the approximate atmospheric boiling point of 50 weight percent aqueous alkali metal hydroxide solutions. Electrolytic cell or reaction zone operating pressures are determined primarily by the ultimate uses of the product hydrogen, and the hydrogen may be generated at pressures up to about 200 atmospheres. Generating the product hydrogen at elevated pressure, in the case of electrolytically induced systems, requires the input of relatively little additional electrical energy.

Many different types of electrolytic cell configurations may be employed in carrying out the metal oxidation/hydrogen production reactions. Most simply, a suitable cell would possess an electrode configuration of woven or expanded metal materials with separators holding the electrodes apart while permitting the free circulation of electrolyte and incoming elemental iron or cobalt feedstock. Alternatively, the electrolytic cell may be composed of a plurality of closely spaced alternating electrode elements, with each electrode element having an extended surface and designed to efficiently release and/or circulate the hydrogen generated. The anode structure of the electrolytic cell is a magnetic anode that is adapted to attract and retain ferromagnetic materials. The magnetic anode may be permanently magnetic or the anode may be made intermittently magnetic by the imposition of a magnetic field.

The cathode of the electrolytic cell can have the same structure as the anode. It is preferred that the cathode be prepared from or coated with a material that will serve to catalyze the dissociation of water to hydrogen. Platinum, palladium and nickel, particularly Raney nickel, are effective reaction promoters. Raney nickel is the most preferred promoter and the cathode accordingly may be fabricated from or coated with Raney nickel. The cathode may be a magnetic cathode and the Raney nickel promoter retained on the cathode with the cathode magnetic field. Platinum or palladium, while effective, are less desired because they tend to be poisoned by the presence of sulfur species. As noted above, it is preferred to have some sulfur species present in the cell since they tend to promote the rapid anodic oxidation of an iron feedstock.

As noted above, the oxidation of iron or cobalt in an aqueous alkali metal hydroxide solution proceeds spontaneously with the production of hydrogen. Accordingly, the electrochemical oxidation of iron or cobalt in an aqueous alkali metal hydroxide electrolyte proceeds without the imposition of an input voltage, that is, hydrogen is produced with the oxidation of iron or cobalt under short circuit conditions. The oxidation of iron under short circuit conditions occurs at temperatures as low as 25° C.; however, the oxidation of cobalt under short circuit conditions proceeds at temperatures greater than about 110° C. Therefore, the rate of hydrogen evolution in a short circuit electrolytic environment is accelerated with increasing process temperature. Of course, the imposition of an input voltage on the system will accelerate the rate of hydrogen formation.

Figure 2:
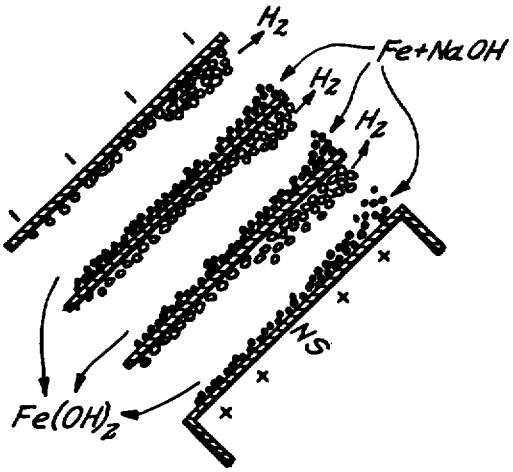
FIG. 2 is a representation of a bipolar cell showing formation of hydrogen and oxidation of elemental iron to ferrous hydroxide.

FIG. 1 shows one process embodiment of the present invention. As shown in the figure, hydrogen is produced by passing elemental iron and sodium hydroxide to an electrolytic cell. The anode of the cell is preferably magnetized to retain the incoming iron particles on the surface thereof. Incoming iron, in the presence of sodium hydroxide electrolyte, is converted to ferrous hydroxide and hydrogen is evolved at the cathode. The ferrous hydroxide is withdrawn from the system and passed to a rotary kiln or fluidized bed reactor wherein it is contacted with a carbon source, preferably coal, in the presence of air and steam to reduce the same to elemental iron. As shown in FIG. 1, the elemental iron is then returned to the electrolytic hydrogen generation zone. As shown in FIG. 2, conventional magnetic bipolar cells can also be used for the generation of hydrogen. As shown in FIG. 2, elemental iron and sodium hydroxide are passed through the cell structure with the iron being retained on the magnetized anode structures for subsequent oxidation to ferrous hydroxide with the simultaneous production of hydrogen at the cathode. The ferrous hydroxide is released from the magnetic anode structures since it is not ferromagnetic and is passed from the bipolar cell for subsequent reduction to elemental iron.

Figure 3:
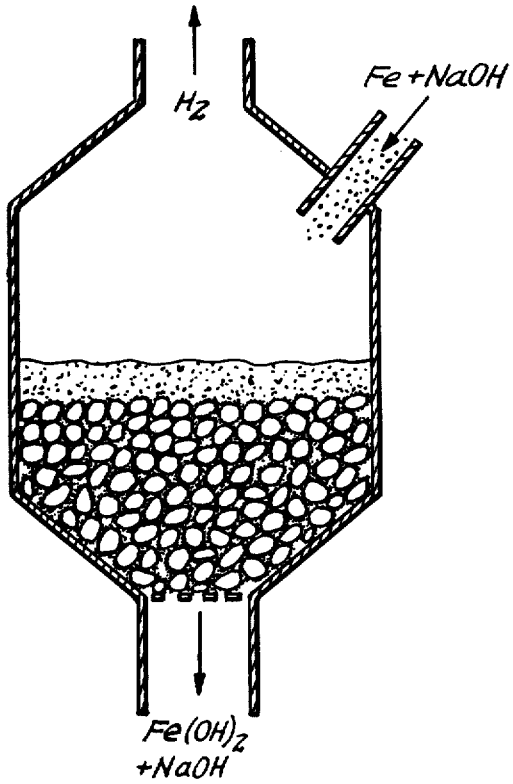
FIG. 3 is a representation of a processing scheme for the production of hydrogen under electrochemical short circuit conditions.

Because hydrogen can be produced with the present electrochemical couple at short circuit conditions, the electrolytic cell may be a single electrode system. For example, the electrode may be composed of a magnetic or magnetizable support structure which functions as the cathode and a layer of iron or cobalt particles. A more preferred single electrode structure would be a magnetic support material having a thin layer of a hydrogen evolution catalyst, preferably Raney nickel, which in turn is contacted by the elemental iron or cobalt anode material. With this type of structure, the electrochemical reactions are short circuited "internally". The magnetic support material of the electrode need not be electrically conductive and may simply consist of a permanent magnet coated with a polymeric substance, e.g., polyolefins, polytetrafluoroethylene, polyamides, etc. that is resistant to the process environment. A particularly attractive cell structure is depicted in FIG. 3 and comprises a plurality of small electrode beads, each electrode bead consisting of a permanent magnet coated with Raney nickel and the elemental iron (or cobalt) feedstock. Hydrogen is produced in a reaction vessel containing a plurality of such beads. The reaction zone is suitably manifolded to maintain reaction zone pressure and to permit the removal of hydrogen from the reaction zone. Similar means would be required in the reaction vessel to permit the introduction of process electrolyte and elemental iron feed and the withdrawal of iron oxidation products and electrolyte from the reaction zone. Of course, with this type of system, the rate of hydrogen production would be controlled by process temperature rather than by the imposition of an external voltage on the system as would be the case with a more typical electrochemical cell. Reaction temperatures could be maintained by passing a heat transfer fluid through coils positioned within or along the outer periphery of the reactor.

In the operation of the metals oxidation portion of the process of the present invention, a flow system is preferably employed. Typically, aqueous electrolyte is introduced into the electrochemical cell, which may be a single electrode or multiple electrode system and which may be operated under short-circuit or under imposed voltage conditions. In a nonelectrolytic system, aqueous alkali metal hydroxide is introduced into the reaction zone. Elemental iron or cobalt particles are introduced either continuously or intermittently to the cell or reactor depending upon the rate of its consumption. In either system, the metal particles may be introduced as a slurry with the aqueous solution or may be introduced independently using other means. Depending on the reaction conditions, the solution withdrawn from the electrolytic cell or reactor may contain either dissolved or dispersed metal oxidation by-products. With the use of the magnetic anode electrolytic system, the incoming iron or cobalt fuel is distributed over the electrode(s) in such a manner that it will be picked up by the magnetic anode and retained on the surface thereof. During the course of oxidation, the ferromagnetic iron particles will be converted to non-ferromagnetic oxidation species which are released from the anode and passed from the system with the circulating electrolyte or independently using other means. In either a chemical or electrochemical system, the metal oxidation products may be recovered from the aqueous working fluid by using typical unit operations such as filtration, settling, centrifugation, etc. Depending upon process conditions, in particular process temperature and alkali metal hydroxide concentration, all or a portion of the metal oxidation by-products may be dissolved in the electrolyte solution. In these situations, the electrolyte will be treated with a suitable precipitating agent to recover the metal oxidation materials from solution.

Alternatively, the dissolved metal oxidation products such as iron hydroxides and the like may be recovered from solution by diluting the aqueous base solution with additional water. Typically, elemental iron or cobalt is present in a nonelectrolytic system in amounts ranging from 10 to 70 wt. %, preferably from about 10 to 30 wt. % of the total weight of metals plus aqueous alkali metal hydroxide solution. In an electrolytic system, the amount of metals present within the reaction zone can vary over a wide range because large portions of the metal may be retained within the system on the magnetic electrodes. A sufficient quantity of electrolyte is supplied to the electrolytic system to assure immersion of the anode and cathode in the fluid electrolyte.

At least a portion of the nonferromagnetic iron or cobalt oxidation products from the electrolytic cell or reactor are reduced to their elemental form by contacting the same with a carbonaceous reducing agent at elevated temperatures. All or a portion of the reduced elemental iron or cobalt feedstock may be returned to the electrolytic cell or reactor and the cycle repeated. The reduction operation can be conducted using a variety of techniques. For example, the iron oxidation products may be introduced to a fluidized bed reduction process wherein the iron oxidation products are reduced substantially to metallic iron by direct contact with a carbonaceous reducing agent, preferably carbon monoxide, at temperatures above about 1000° F. Processes of this general type may be carried out in a single stage or in a multiple stage operation. When a multiple stage process is used, the iron oxidation products are introduced to a first fluidized bed wherein they are preheated or preheated and reduced from the ferric or ferrous state to a lower oxidation state and are then further reduced in subsequent beds to elemental iron. Each of the several stages are operated at the same or different elevated temperatures with carbon monoxide being used as the fluidizing and reducing medium. The carbon monoxide employed in the process can be produced by steam reforming or partial oxidation of natural gas, petroleum liquids or coal. Similar operations may be used for the reduction of cobalt oxidation products.

Another technique that may be employed for the reduction of the oxidized iron materials using coal as a reductant consists of a technique wherein coal and the oxidized iron material are admixed, sent to a reaction zone (rotary kiln or fluidized bed reactor) and therein contacted with air alone or in combination with steam to simultaneously gasify the coal to produce the carbonaceous reducing agent required to convert the oxidized iron material to elemental iron. For example, a three stage system can be employed. In stage one the oxidized iron materials will first be preheated to a temperature of about 1500° F. by contact in a fluidized bed with a hot reducing gas or preheated air. This preheated material will then be admixed with about one part of pulverized coal to three parts of iron material and passed to a reducing zone where it is maintained in a fluidized state with incoming superheated steam and oxygen. The steam and oxygen will serve to fluidize the bed to ensure contact of the iron material with the coal and simultaneously gasify the coal to produce carbon monoxide reducing agent and by-product spent coal. This reduction is conducted at temperatures ranging from 1000° to 1800° F. Upon completion of the reduction operation, the mixture is cooled below the Curie point of iron and the material is separated from the excess coal or spent char using conventional magnetic separation techniques. In this type of operation, a portion of the iron material could be converted to iron sulfide due to the presence of sulfur species in the coal. As noted above, the presence of the iron sulfur species in the recycle iron to the electrolytic cell does not adversely affect a subsequent electrolytic operation since the presence of the sulfur tends to promote the facile oxidation of the iron in the electrolytic cell. The reduction of cobalt oxides and/or hydroxides is secured with a similar operation or by heating the same mixed with charcoal at temperatures above about 1000°-1100° C.

EXAMPLE

Figure 4:
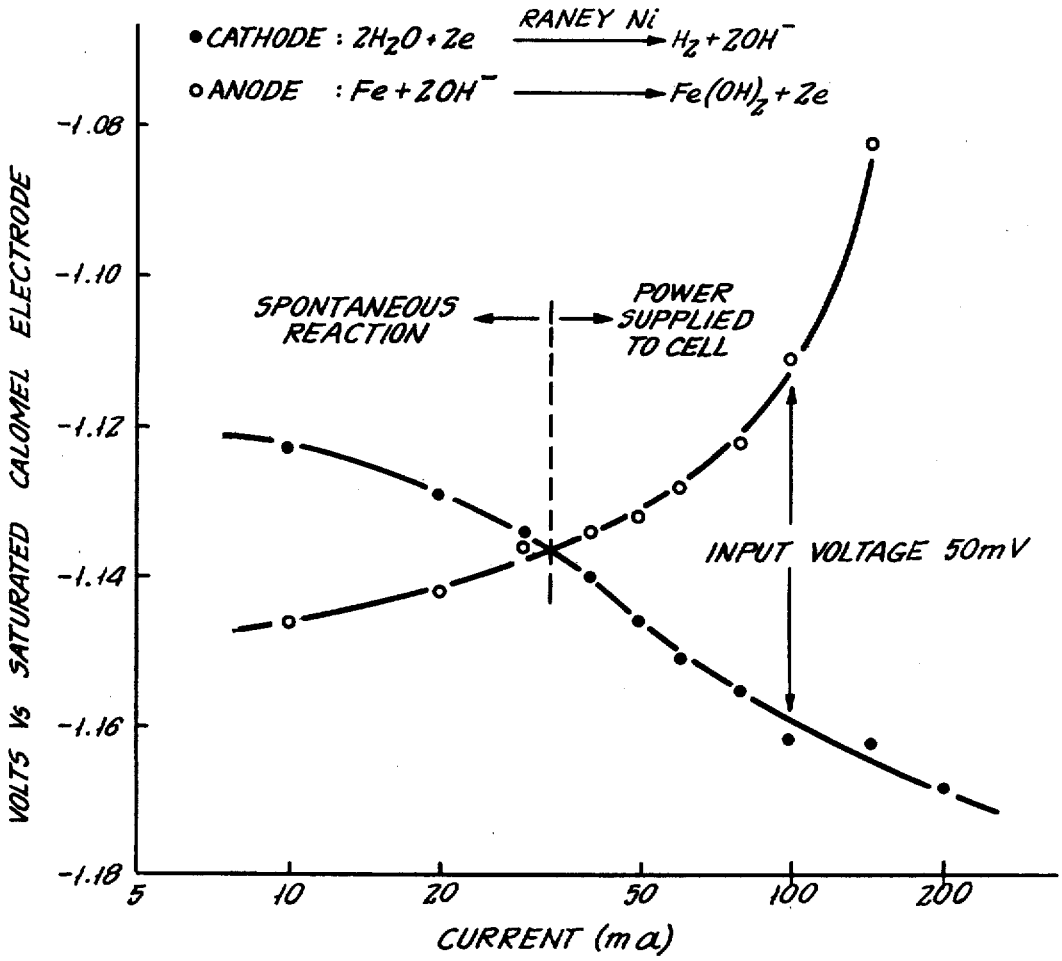
FIG. 4 are voltage/current polarization curves for hydrogen production by the oxidation of elemental iron.

A test was conducted to demonstrate the electochemical production of hydrogen via the anodic oxidation or iron. An electrode system comprising a magnetically stabilized anode and cathode was used. The anode consisted of a permenent magnet covered with a nickel foil. Iron carbonyl powder was maintained in position on one surface of the nickel foil by the magnet. The cathode was identical to the anode except that Raney nickel powder was dispersed on the nickel foil surface rather than iron carbonyl powder. The electrodes were connected across a galvanostat. The reaction was conducted at 85° C. and a 30 wt. % aqueous solution of potassium hydroxide was employed as the process electrolyte. With this experimental apparatus, the FIG. 4 voltage/current polarization curves were generated. The data indicates that a positive potential was developed and a short circuit current of 30 milliamperes observed. The short-circuit current increased to more than 100 milliamperes when the reaction temperature was increased to 91° C. At 85° C. more than 100 milliamperes of current (hydrogen evolution) could be obtained when 0.05 volts of external voltage was applied to the system.

What is claimed is:

1. A process for manufacturing hydrogen which comprises:

(a) passing an aqueous electrolyte and elemental iron or cobalt particles to an electrolytic cell comprising a cathode and a magnetic anode, said anode adapted to attract and retain said iron or cobalt particles;

(b) anodically oxidizing at least a portion of said iron or cobalt particles to non-ferromagnetic iron or cobalt containing species with the generation of hydrogen at said cathode;

(c) passing said hydrogen and said oxidized, non-ferromagnetic iron or cobalt containing species from said cell;

(d) reducing at least a portion of said oxidized, non-ferromagnetic iron or cobalt containing species to elemental iron or cobalt by contacting the same with a carbonaceous reducing agent at elevated temperatures; and (e) recycling at least a portion of the elemental iron or cobalt from step (d) to step (a).

2. The process of claim 1 wherein said electrolyte is an aqueous alkali metal hydroxide solution.

3. The process of claim 1 wherein said hydrogen is produced using elemental iron particles.

4. The process of claim 1 wherein the said anodic oxidation is conducted at temperatures ranging from 80° to 400° C.

5. The process of claim 4 wherein said electrolyte is an aqueous sodium hydroxide solution.

6. The process of claim 5 wherein said hydrogen is produced using elemental iron particles.

7. The process for manufacturing hydrogen which comprises:

(a) passing an aqueous alkali metal hydroxide solution and elemental iron or cobalt particles to a reaction zone;

(b) oxidizing at least a portion of said iron or cobalt particles at a temperature ranging from about 80° to 400° C. to iron or cobalt oxidation products with the simultaneous generation of hydrogen;

(c) passing said hydrogen and said iron or cobalt oxidation products from said reaction zone;

(d) reducing at least a portion of said iron or cobalt oxidation products to elemental iron or cobalt by contacting same with a carbonaceous reducing agent at elevated temperatures; and (e) recycling at least a portion of the elemental iron or cobalt from step (d) to step (a).

8. The process of claim 7 wherein said hydrogen is produced using elemental iron particles.

9. The process of claim 7 wherein said alkali metal hydroxide solution is an aqueous sodium hydroxide solution.

10. The process of claim 9 wherein said hydrogen is produced using elemental iron particles.

* * * * *